US007237753B2

(12) United States Patent
Metcalfe

(10) Patent No.: US 7,237,753 B2
(45) Date of Patent: Jul. 3, 2007

(54) DEBRIS COLLECTING BAG AND BAG HOLDER

(76) Inventor: Donna Metcalfe, 22 Bramble Court, Stouffville, Ontario (CA) L4A 7Y6

( * ) Notice: Subject to any disclaimer, the term of this patent is extended or adjusted under 35 U.S.C. 154(b) by 0 days.

(21) Appl. No.: 10/983,633

(22) Filed: Nov. 9, 2004

(65) Prior Publication Data

US 2005/0103951 A1 May 19, 2005

(51) Int. Cl.
*B65B 67/04* (2006.01)

(52) U.S. Cl. ..... 248/99; 193/25 R; 193/15; 220/908.3; 248/95; 248/100; 383/12

(58) Field of Classification Search ..... 248/95, 248/99, 100, 101, 97, 150; 220/9.1, 9.2, 220/9.3, 9.4, 495.01, 23.9, 495.06, 908.3; 193/2 R, 15, 30, 25 R; 383/12, 33; 141/10, 141/109, 114, 372, 313, 390, 392, 108; 56/329; 232/43.1, 43.2

See application file for complete search history.

(56) References Cited

U.S. PATENT DOCUMENTS 1,278,385 A * 9/1918 Richard ..... 248/94
1,647,679 A * 11/1927 Williams ..... 220/9.2
1,714,308 A * 5/1929 Gunderson ..... 141/390
2,073,914 A * 3/1937 Wilfley ..... 141/314
2,636,656 A * 4/1953 Sadami ..... 141/314
3,248,001 A * 4/1966 McGinnis ..... 100/211
3,438,322 A * 4/1969 Marasco ..... 100/233
3,480,059 A * 11/1969 Schoening ..... 220/9.2
3,583,748 A * 6/1971 Arndt ..... 294/68.24
3,692,072 A * 9/1972 Kohls ..... 141/391
4,200,127 A * 4/1980 Dunleavy ..... 141/10
4,287,701 A * 9/1981 Washington ..... 53/390
4,299,365 A * 11/1981 Battle ..... 248/99
4,610,039 A * 9/1986 Stern ..... 4/285
5,014,944 A * 5/1991 Malik et al. ..... 248/99
5,058,839 A * 10/1991 Stevens ..... 248/97
5,090,756 A * 2/1992 Pfisterer ..... 294/1.1
5,213,141 A * 5/1993 Dorman ..... 141/10
5,393,023 A * 2/1995 Callan ..... 248/97
5,449,083 A * 9/1995 Dougherty et al. ..... 220/9.1
5,562,593 A * 10/1996 Sammel ..... 588/261
5,570,862 A * 11/1996 Nugent ..... 248/97

(Continued)

*Primary Examiner*—Kimberly Wood
(74) *Attorney, Agent, or Firm*—Miller Thomson LLP

(57) ABSTRACT

A debris collector is provided that includes a sleeve including a top opening and a bottom opening, the sleeve being operable to be attached to a bag adjacent to the bottom opening, the sleeve defining an interior. A support structure is connected to the sleeve, the support structure consisting of at least one support element, wherein the support element is manually operable to bring the sleeve in a generally upright position that permits debris to be readily inserted into the opening. The sleeve also includes a connecting means for connecting the bag to the sleeve. The sleeve is operable to funnel debris inserted in the top opening from the interior into the bag through the bottom opening. The sleeve and the support structure cooperate to permit a user to manually operate the debris collector to achieve a collapsed position that permits debris to be collected on top of the sleeve and wherein the sleeve and the support structure permit a user to direct the debris collected on the top of the sleeve into the interior and then into the bag by lifting the sleeve. A method of collecting debris using the debris collector is also provided.

9 Claims, 7 Drawing Sheets

U.S. PATENT DOCUMENTS 5,593,117 A * 1/1997 Alexander, III ..... 248/99
5,597,022 A * 1/1997 Reifers ..... 141/390
5,871,037 A * 2/1999 Feldt ..... 141/391
5,884,454 A * 3/1999 Steinmetz ..... 53/459
5,996,999 A * 12/1999 Casely ..... 273/148 R
6,155,522 A * 12/2000 Anderson ..... 248/99
6,315,143 B1 * 11/2001 Dotts ..... 220/9.2
6,378,581 B1 * 4/2002 Sheridan et al. ..... 150/159
6,415,927 B1 * 7/2002 Stone et al. ..... 206/600
6,497,317 B1 * 12/2002 Chun ..... 193/25 R
6,554,810 B1 * 4/2003 Wilk et al. ..... 604/323
6,651,942 B1 * 11/2003 Yardley et al. ..... 248/100
6,708,835 B1 * 3/2004 Mathis ..... 220/4.03
6,830,170 B2 * 12/2004 Abel ..... 224/634
6,994,302 B1 * 2/2006 Simmons ..... 248/98
2003/0106895 A1 * 6/2003 Kalal ..... 220/9.2
2003/0183630 A1 * 10/2003 Schneider et al. ..... 220/9.2

* cited by examiner

DEBRIS COLLECTING BAG AND BAG HOLDER

FIELD OF INVENTION

This invention relates generally to an apparatus for collecting outdoor debris. This invention relates more particularly to a yard debris bag holder. The invention also relates to a modified debris bag.

BACKGROUND OF INVENTION

It is common to use paper or plastic bags to collect outdoor debris. The debris may include garbage, but also yard debris such as leaves, grass clippings and the like.

Conventionally when yard debris like leaves are raked or blown into a pile, a person must gather the raked/blown material by hand and place it into a bag that also must be held open. This lacks efficiency in that completion of the task generally requires further raking/blowing as usually not all of the pile is easily placed into the bag on one attempt. This, as a result, increases the number of times a person must bend and lift to pick up the debris.

For this reason, some people use devices such as plastic tarps, blankets, etc. to hold the debris (especially in this case leaves) and then load them into a trash bag for disposal. This method generally requires the debris to be lifted from the ground and placed in the open end of a bag.

In addition, there are a number of devices that keep the mouth of a bag open for easier placement of debris in the bag.

For example, U.S. Pat. No. 5,593,117 issued Jan. 4, 1997 to Alexander discloses a lawn and garden debris collecting apparatus. The apparatus consists of a forward component and rearward components, the two being connected by a flexible strap. The forward component includes a solid frame defining an open channel into which debris is introduced. The forward component and rear component together hold the bag in place.

U.S. Pat. No. 5,655,739 issued to The-Wah Goo on Mar. 23, 1995 discloses a bag holder including a scoop and a locking ring for engaging the scoop and maintaining a bag in position on the scoop. The scoop is a hollow device with a mouth and a base. A channel extends inwardly from the mouth of the scoop towards the base. In use, a bag is retained in an open position between the ring and the base of the scoop, and a user funnels debris into the mouth, through the scoop, and into the bag.

U.S. Pat. No. 5,011,103 issued to Hayes on Apr. 5, 1990 discloses a collapsible frame that supports a leaf bag in such a position that a portion of the bag rests horizontally on the ground and the remainder of the bag is so attached to the frame so as to present a large arch-shaped opening to facilitate the collection of leaves, grass trimmings and other garden and lawn debris. The arch is formed by an overhead, resilient rod member inserted through an overhead receiving hem or fabric tunnel in or adjacent the perimeter of entrance to the bag. A pair of elongated rigid stabilizing feet are placed along the ground within the entrance to the bag. The ends of the overhead rod member are then inserted in an upwardly facing support cavity on each stabilizing foot. The frame is collapsed by removing the resilient rod member from the pair of elongated rigid stabilizing feet.

Therefore, it can be seen that there is a need for an improved bagger apparatus, particularly a collapsible wide-open device. This invention allows for a greater amount of yard debris to be raked or blown onto the apparatus at one time thereby reducing the raking/blowing, bending and lifting associated with leaf gathering.

There are a number of disadvantages in the prior art. One disadvantage is that the prior art devices generally contain numerous parts and are relatively difficult to manufacture and to assemble, and expensive to produce. Another disadvantage, is that in ordinary use, it is sometimes desirable to rake or blow the debris into the opening of the bag, other times it is desirable to move the debris into a pile on a collecting device in a collapsed position.

There is therefore a need for a dual upright/collapsed position collection device that is easy to manufacture and use.

SUMMARY OF THE INVENTION

A debris collector is provided which includes a sleeve. The sleeve is attached to or integral with a bag, or bag portion. The sleeve is adapted to funnel debris into the bag or bag portion. The sleeve includes a top opening and bottom opening, and a frame consisting of a first and second support elements that are attached to or part of the sleeve. The first and second support elements enable a user to manually place the sleeve either into an upright position or a collapsed position. The upright position enables debris to be directed inside the sleeve so as to funnel the debris into the bag or bag portion. The collapsed position permits debris to be collected on top of the sleeve and then directed into the bag by lifting the sleeve.

The sleeve consists of a piece of material. The second support element angled so as to lean toward the first support element in the upright position thereby providing stability.

In one embodiment of the invention, the sleeve includes fasteners for attaching the sleeve to the opening of a bag.

In another embodiment of the invention, the sleeve attaches to a bag by means of fasteners, or functions as a bag itself by closing the bottom opening using a closure means.

In yet another embodiment of the invention, the sleeve is integral with a bag.

Another aspect of the invention is a method for collecting debris.

BRIEF DESCRIPTION OF THE DRAWINGS

A detailed description of the preferred embodiment(s) is (are) provided herein below by way of example only and with reference to the following drawings, in which.

Figure 1:
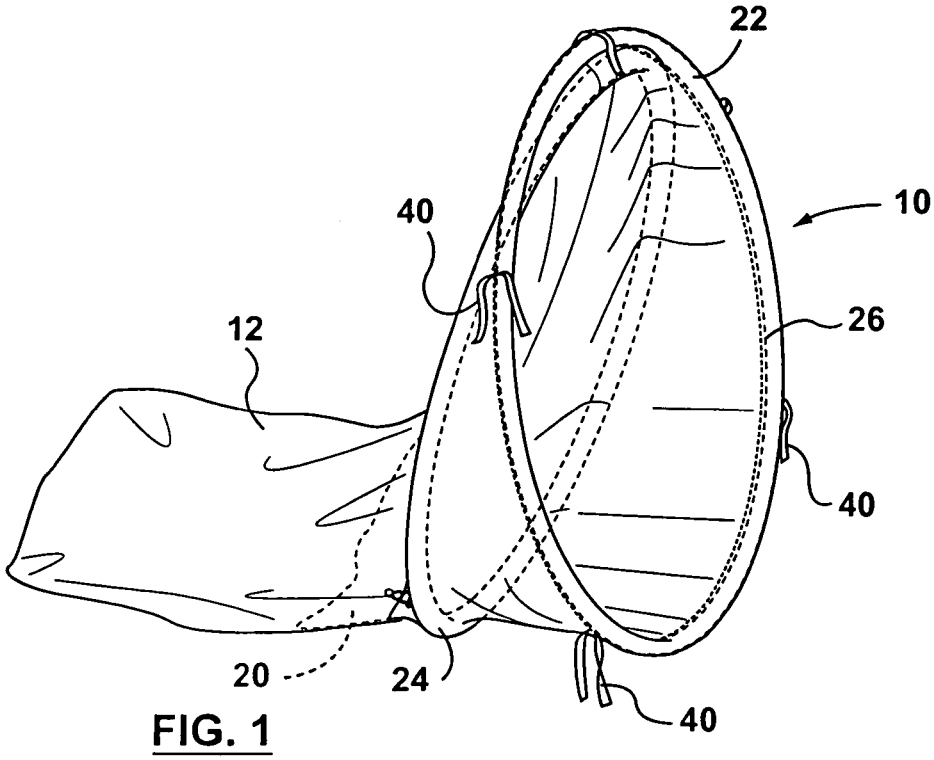
FIG. 1 is a perspective, partial cut-away view of the bag holder of the present invention with the bag holder in an upright position.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF INVENTION

As shown in FIG. 1, the present invention, in one embodiment thereof, is a bag holder or bag attachment 10 that attaches to a bag 12 for collecting debris.

Figure 2:
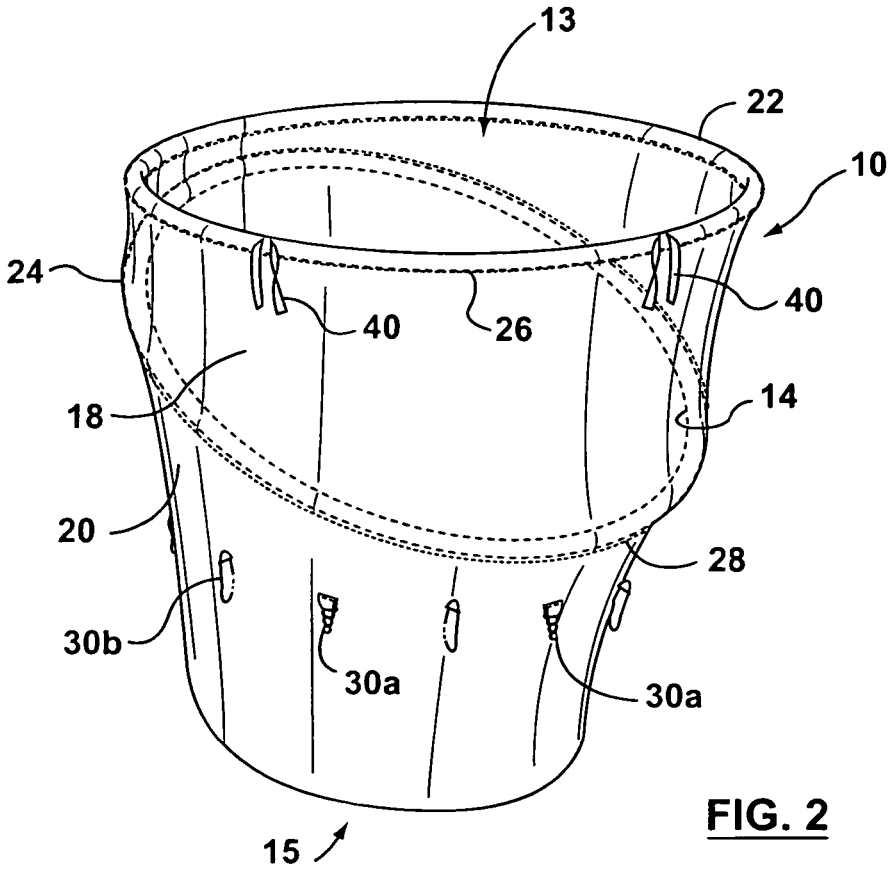
FIG. 2 is a perspective, partial cut-away view of the bag holder of the present invention with the bag holder in an elevated position.

As shown in FIG. 2, the bag holder 10 includes a sleeve 14. The sleeve 14 of the present invention operates as a funnel to direct debris into the bag 12. The sleeve includes a frame consisting of at least two support elements 22 and 24 which are manually moveable by a user such that the sleeve 14 can be manipulated to achieve either an upright or vertical position, or a collapsed position.

The upright position permits debris to be directed inside the sleeve 14 so as to funnel the debris into the bag 12. The collapsed position permits debris to be collected on top of the sleeve 14 and then directed into the bag 12 by lifting the sleeve 14.

The sleeve 14, in one particular embodiment of the present invention, consists of a sleeve of material with a top opening 13 disposed at one end of the sleeve 14, and a bottom opening 15 disposed at the opposite end of the sleeve. The sleeve 14 is preferably made of a flexible, durable, lightweight material that is easy to clean, such as for example a woven nylon fabric. It should be understood that a variety of other materials can be used.

The sleeve 14 includes at least two support elements 22 and 24. The first support element 22 is disposed adjacent to the top opening 13. The second support element 24 is disposed further along the axis of the sleeve 14, closer to the bottom opening 15. In one embodiment of the invention, the support elements 22 and 24 are integral to the sleeve 14. Alternatively, the support elements 22 and 24 could be mounted in a fixed position on the sleeve 14. The support elements 22 and 24 are disposed such that the sleeve 14 when placed on its side is preferably self-supporting, as best shown in FIG. 1. As shown in FIG. 2, in the particular embodiment of the invention described, this is achieved by the first support element 22 enclosed within the fabric comprising the sleeve 14, in a first enclosure 26. Similarly, the second support element 22 is enclosed within the fabric comprising the sleeve 14, in a second enclosure 28. The second enclosure is disposed at angle from the first enclosure 26, as shown in FIG. 2.

As a result, the first and second support elements 22 and 24, and therefore the bag holder 10 itself, are self-supporting in the vertical or upright position illustrated in FIG. 1. Specifically, the second support element 24 tends to lean toward the first support element 22. Because each of the first and second support elements 22 and 24 are retained within the corresponding first enclosure 26 and second enclosure 28, they tend to maintain the upright vertical position illustrated in FIG. 1.

The first and second support elements 22 and 24 in a particular aspect of the described embodiment of the present invention consist of a circular plastic article of a general hoop-type structure. This particular element is used because it is readily available (and therefore inexpensive to use) and also because of the inherent strength of such a circular element. Other shapes could be used also, however, for example a square or rectangular frame.

Figure 4:
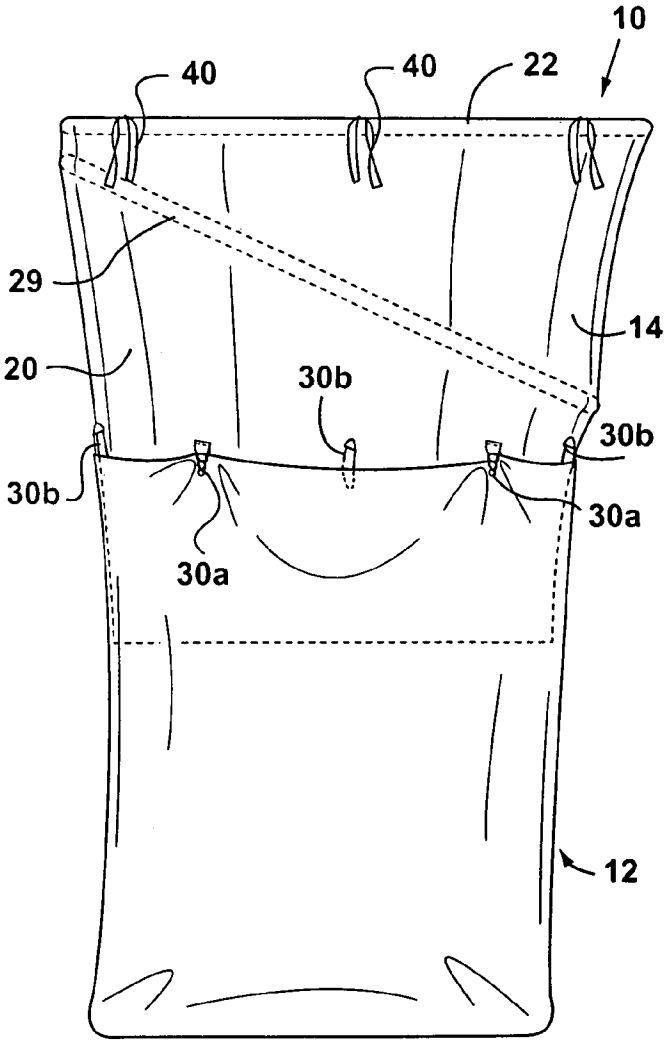
FIG. 4 is a side view, partly cut-way, of the bag holder of the present invention, in one embodiment thereof.
Figure 3:
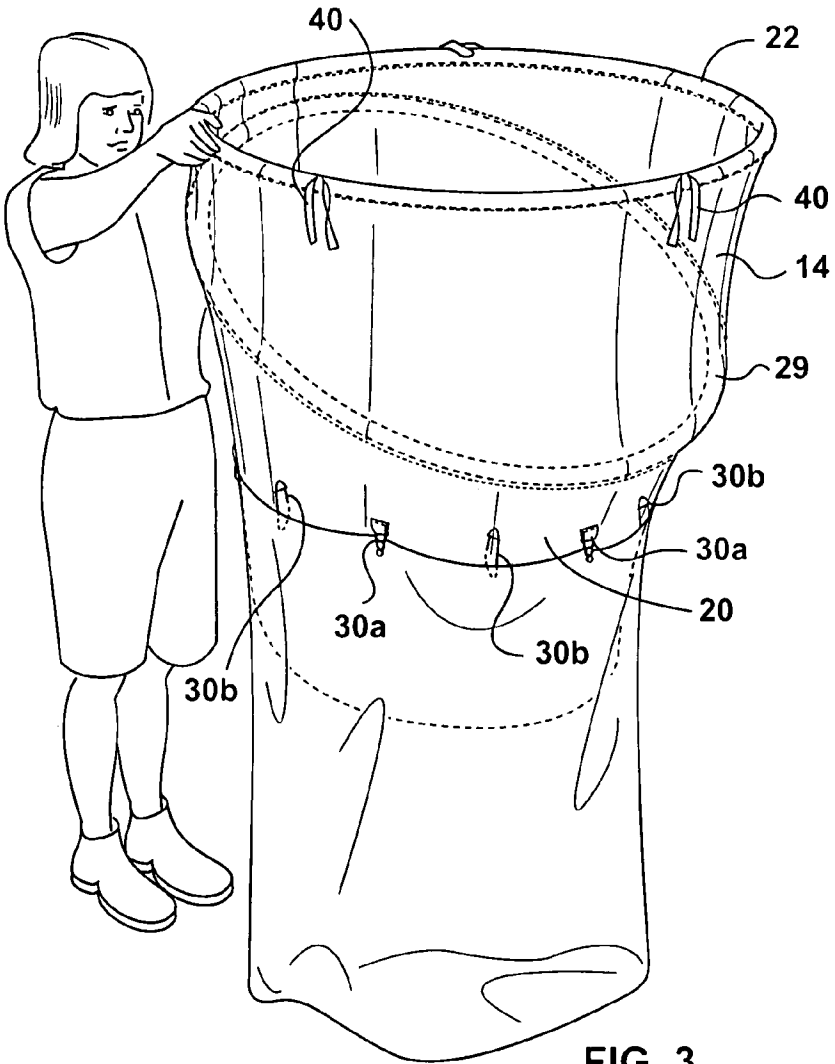
FIG. 3 is a further perspective, partial cut-away view of the bag holder of the present invention in an elevated position, as elevated by a user in operation.
Figure 6:
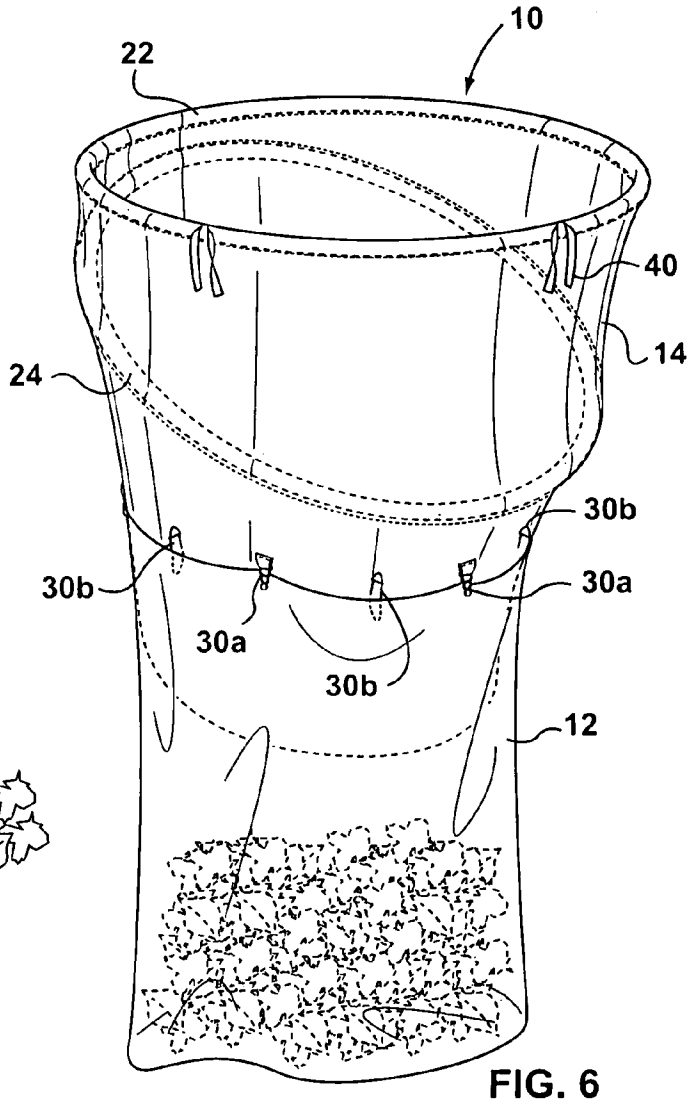
FIG. 6 is a still further perspective, partial cut-away view of the bag holder of the present invention with the bag holder in an elevated position, illustrating the movement of debris placed inside the bag holder to the interior of the bag.

As shown in FIG. 2, the second support element 24 divides the sleeve 14 into an upper portion 18 and a lower portion 20. The lower portion 20 is adapted to lead the debris into the bag 12. The lower portion 20 includes a plurality of fasteners 30 for attaching the bag 12 to the bag holder 10, as best shown in FIGS. 3 and 4. A wide array of different types of fasteners 30 can be used. In one particular embodiment of the invention a plurality of fasteners 30 are organized along the periphery of the lower portion 20. The fasteners 30 are manually operated to attach to the top portion of a bag as shown in the Figs. The fastener 30 preferably is an attachment device such as a clamp that enables attachment of the bag 12 to the bag holder 10 without tearing the bag 12. As illustrated in FIGS. 3, 4, one aspect of an embodiment of the invention is that the fasteners 30 consist of different types of fasteners 30 mounted on the lower portion 20 in sequence. Each type of fastener 30 is adapted to attach to a different type of bag. The specific fasteners 30 illustrated include clamp or garter belt type fasteners 30*a*, and safety pin type fasteners 30*b*. The clamp type fasteners 30*a* were found to be especially suitable for use in association with a plastic bag, e.g. FIG. 3. The pin type fasteners 30*b*, on the other hand, are particularly suited to fastening to paper bags, e.g. FIG. 9. It should be understood that a wide array of different types of fasteners 30 are contemplated by this invention, as well as various positions therefore on the sleeve 14.

Figure 5:
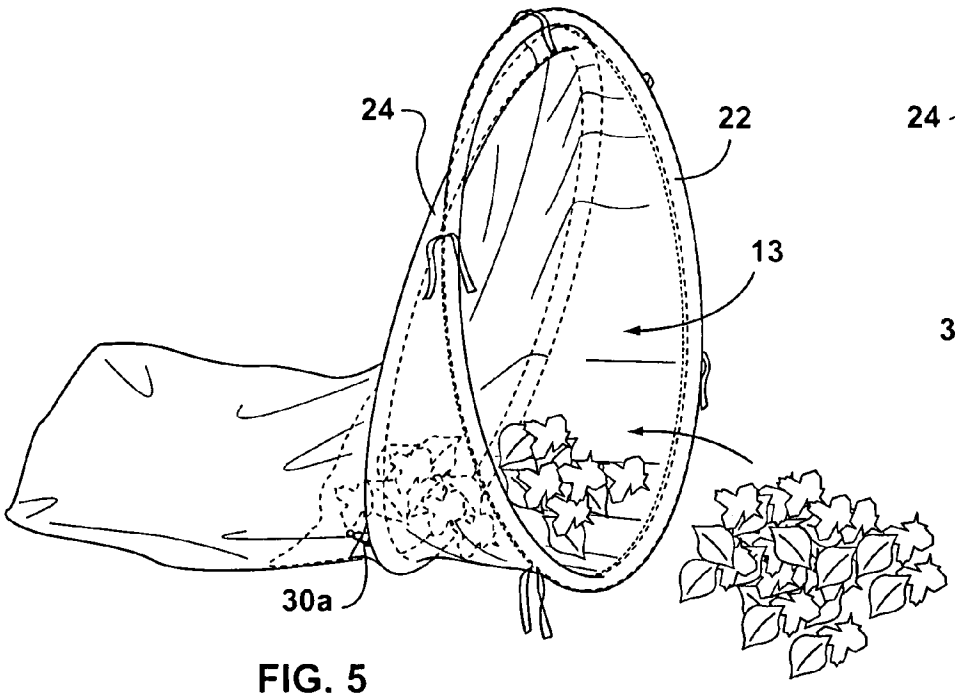
FIG. 5 is a further perspective, partial cut-away view of the bag holder of the present invention with the bag holder in an upright position, illustrating the placing of debris inside the bag holder in one embodiment thereof.

As shown in FIG. 1, the bag holder 10 is adapted to provide the bag/bag holder combination (wherein the bag 12 is attached to the bag holder 10) with an opening when the bag 12 is in a resting position, by means of the upright position of the bag holder 10 described above. This position is readily achieved by setting the first and second support elements 22 and 24 upright, after which the bag 12 tends to maintain this upright position. Accordingly, debris can be introduced (raked or blown, for example) into this first opening 13 without the need to hold the bag holder 10 in place to maintain this opening, as shown in FIG. 5. Then the bag holder 10 can be lifted such that the debris then falls inside the bag 12. The fastener 30 is preferably selected such that the bag 12 continues to be attached to the bag holder 10 even when the bag/bag holder in combination is lifted.

Figure 7:
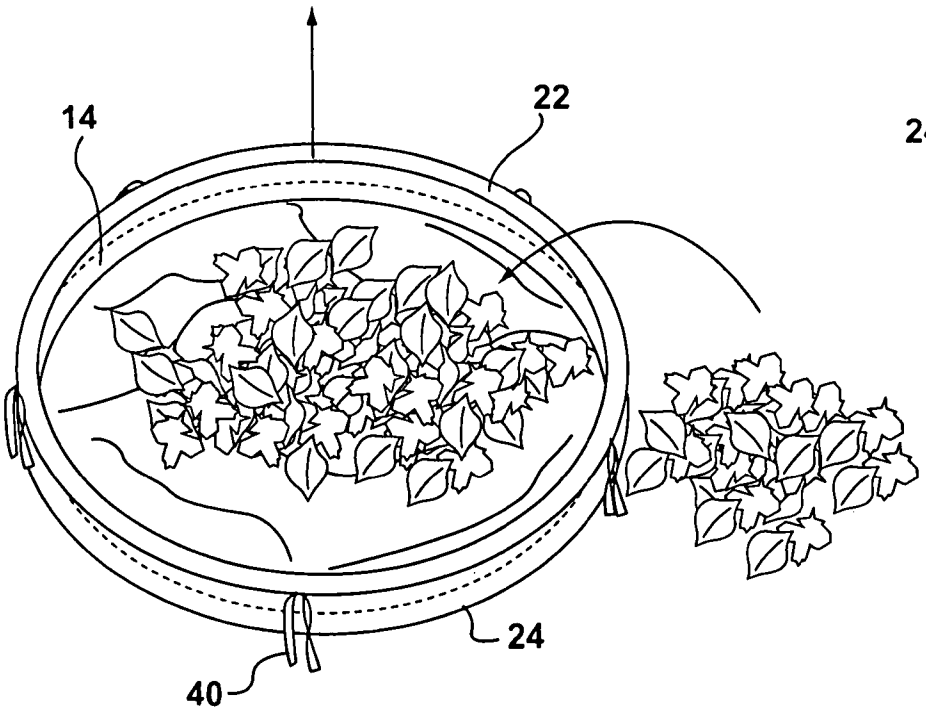
FIG. 7 is a perspective view of the bag holder in a collapsed position, and illustrating the placement of debris on top of the collapsed bag holder.

Alternatively, the bag holder 10 is placed easily by manual operation in the collapsed position illustrated in FIG. 7. In this collapsed position, the first and second supporting elements 22 and 24 generally lie one on top of the other.

Figure 8:
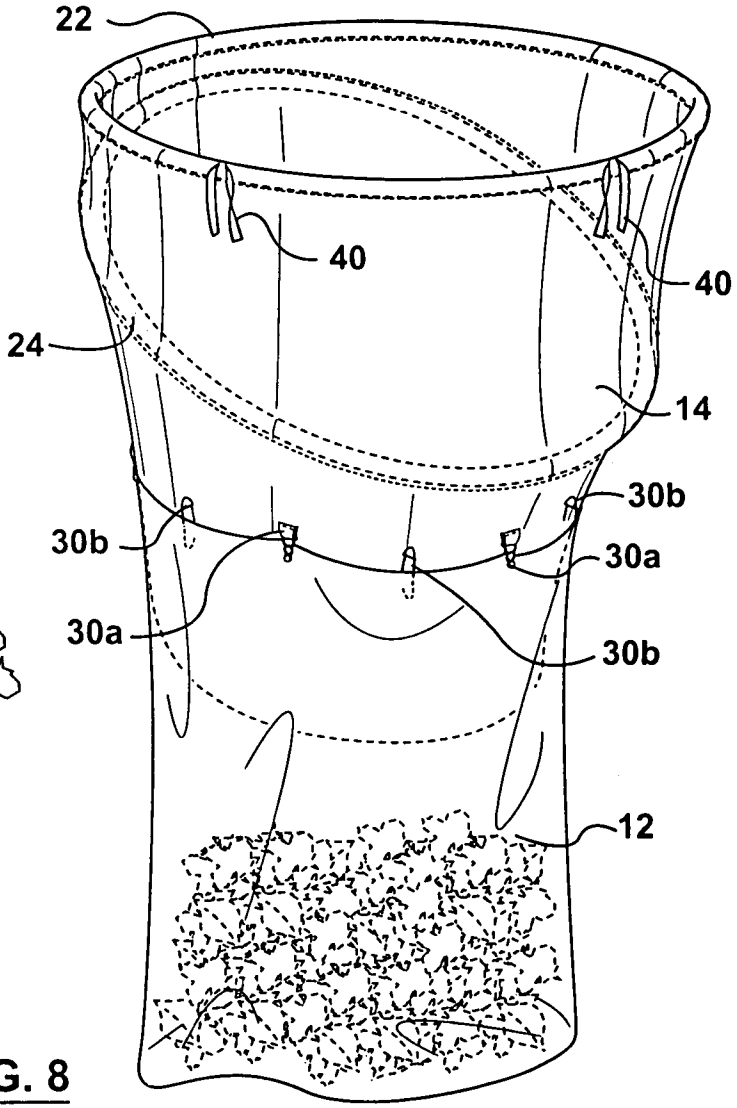
FIG. 8 is yet another perspective, partial cut-away view of the bag and bag holder in an elevated position, illustrating the movement of debris placed on top of the bag holder in the collapsed position, to the interior of the bag when elevated.

Because the bag holder 10 is relatively flat in the collapsed position, debris can be raked on top of the bag holder 10. Alternatively, the debris can be piled on top of the bag holder 10 or blown on top of the bag holder 10. Again, as shown in FIG. 8, once a pile of debris has been placed on top of the bag holder 10 in the collapsed position, the bag holder 10 can be lifted such that the debris then falls inside the bag 12.

Figure 9:
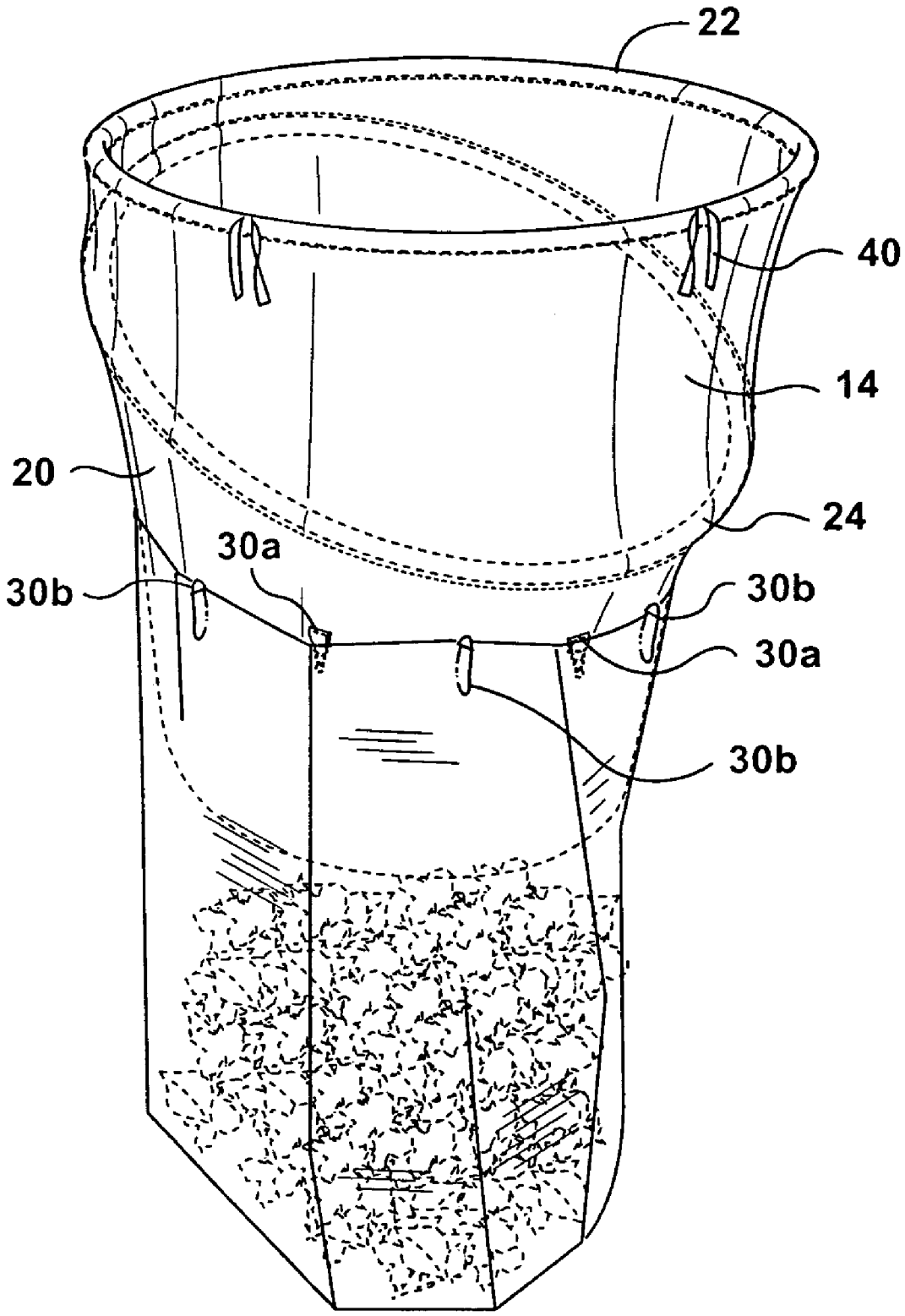
FIG. 9 a perspective, partial cut-away view of the bag holder of the present invention with the bag holder in an elevated position, illustrating the attachment of the bag holder of the present invention to a paper bag.

The bag 12 shown in FIGS. 1-8 is of a standard plastic bag type. In contrast, FIG. 9 illustrates the attachment of the bag holder 10 to a bag that is a standard paper refuse bag. In this case an alternate fastener 30*b* is used to attach the paper bag to the bottom of the lower portion 20 of the sleeve 14 by means of pins, as shown in FIG. 9.

Figures 10, 10A, 11:
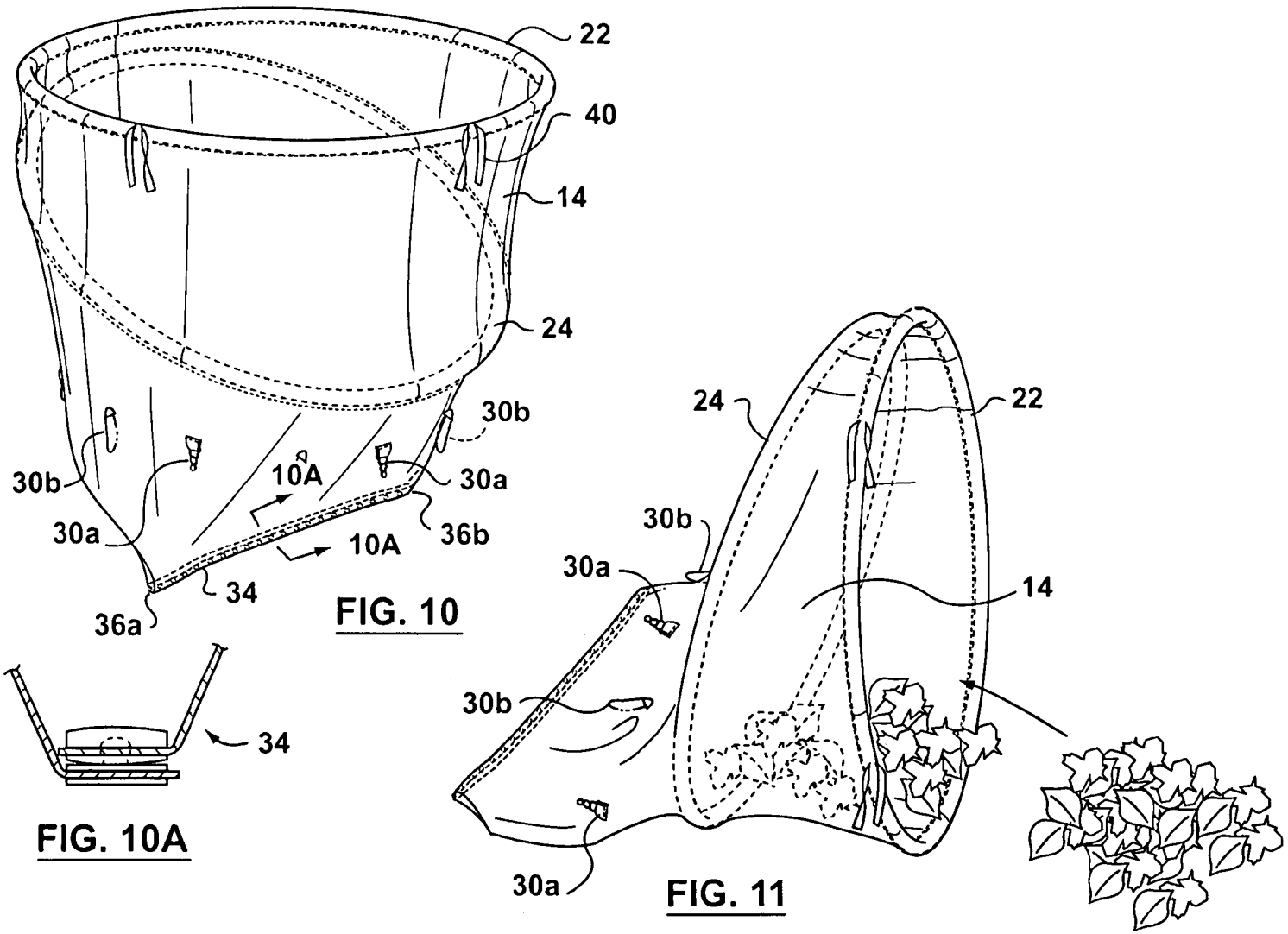
FIG. 10 is a perspective view of the bag holder, in another embodiment thereof, where in the bottom of the bag holder includes a closure.
FIG. 10*a* is a cross-sectional view of the closure illustrated in FIG. 10, along line 10*a*-10*a* shown in FIG. 10.
FIG. 11 is a perspective, partial cut-away view of the bag holder of the present invention including the closure, with the bag holder in an upright position, illustrating the placing of debris inside the bag holder in one embodiment thereof.

In another embodiment of the present invention, the bag holder 10 illustrated in FIGS. 1-9 also functions as a bag. This is achieved by providing a closure 34 adjacent to the bottom of the sleeve 14. FIG. 10*a* illustrates a representative embodiment of the closure 34 which includes a series of male and female interlocking members disposed respectively on one side and the opposite side of the bottom of the sleeve 14 defined by two ends 36*a* and 36*b*. It should be understood that other closure means can be used, e.g. a zipper and the like.

In this other embodiment of the invention, the article can be used either as a bag holder 10 in conjunction with a bag, or as a bag itself, as shown in FIG. 11.

Figure 12:
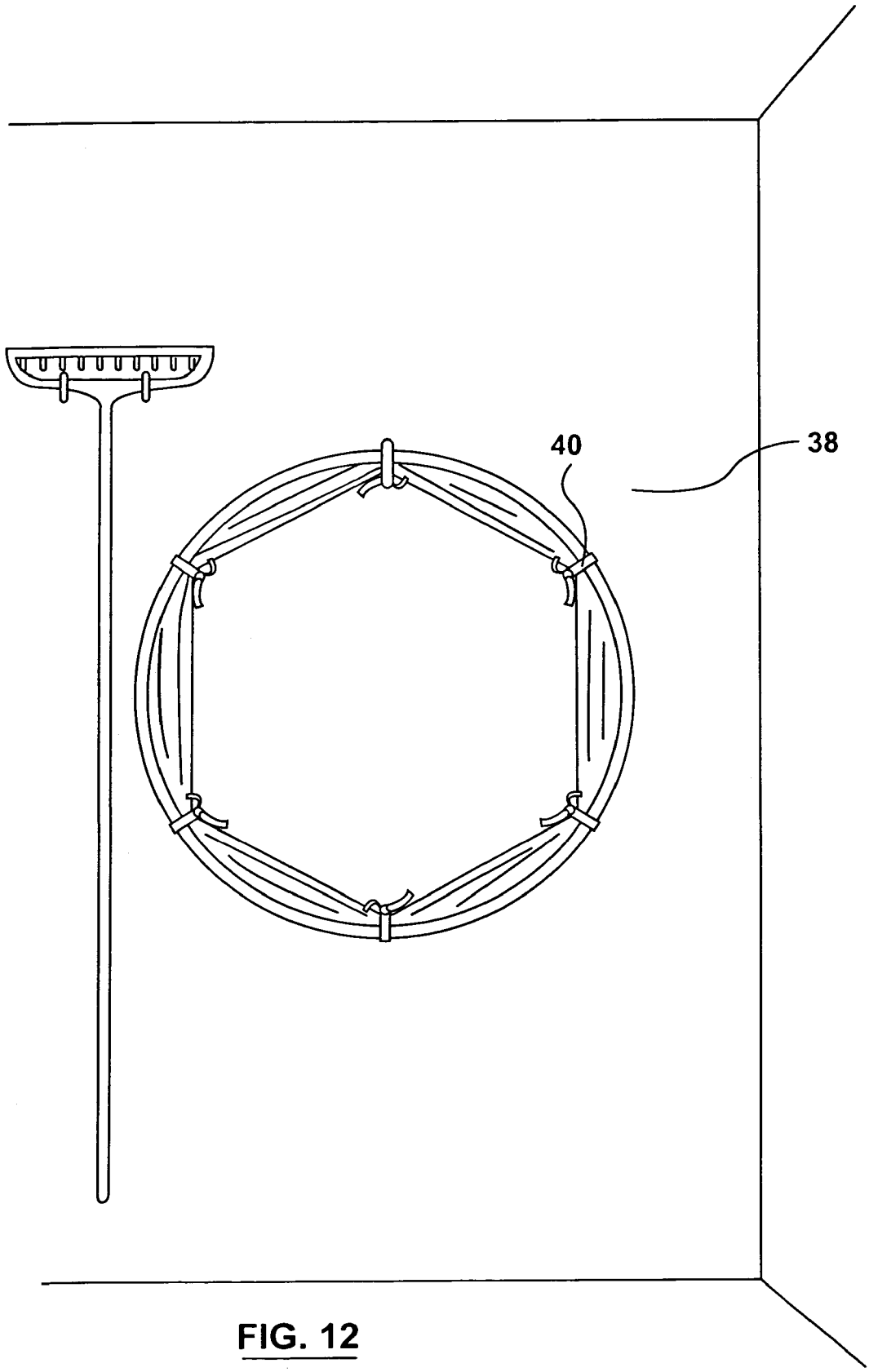
FIG. 12 illustrates the bag holder of the present invention in its stow-away position, mounted on a wall.

As the article of the present invention is collapsible, it is easily stored in a flattened position on a wall 38, as illustrated in FIG. 12, by hanging the first and second supporting elements 22 and 24 around a hook disposed in the wall 38 (hook not shown). A series of ties 40 are disposed adjacent to the first opening for the purpose of tying the sleeve 14. This is for easy storage, as shown in FIG. 12, whereby the article of the present invention is maintained in a substantially flat position, with the fabric of the sleeve 14 gathered close to the frame.

One advantage of the present invention is that it reduces the need for bending, gathering and lifting the debris such as leaves and placing them into a bag. Another advantage of the present invention is its ability to stand independently on most flat surfaces without the help of additional parts, or the need of a relatively complicated structure. Yet another advantage is that the article of the present invention can be used either in the upright position, or the collapsed position as the particular requirements of the terrain or debris, or the preferences of the user, may dictate. A still other advantage of the present invention is that it can be easily stored, and is lightweight.

Yet another embodiment of the invention is one where the sleeve of the present invention is integrated to form a unitary bag wherein the bottom of the bag is permanently closed (not shown). This particular embodiment of the invention is particularly useful in assembling debris that is not deposited for removal, but is deposited in a compost pile, for example.

Yet another aspect of the present invention is a method for collecting debris. The method includes the steps of:

1) Selectively operating a sleeve portion of a bag so as to achieve one of:
   a) An upright position in which first and second support elements maintain the sleeve in a generally open position; or
   b) A collapsed position in which the sleeve is substantially flat when placed on the ground
2) Directing debris into the sleeve in the open position or directing debris on top of the sleeve in the collapsed position; and
3) Lifting the bag from the top of the sleeve so as to funnel the debris from the sleeve into the bag.

Other variations are possible. As mentioned alternate fasteners 30 can be used. The frame may consist of other components, or components having different shapes. Additional components might include components designed to stabilize the bag holder 10 in the vertical position described, for example, a weight inserted in the bag holder.

What is claimed is:

1. A debris collector comprising:

(a) a sleeve including a top opening and a bottom opening, the sleeve being operable to be attached to a bag adjacent to the bottom opening, the sleeve defining an interior;

(b) a connecting means for connecting the bag to the sleeve; and (c) a support structure connected to the sleeve, wherein the support structure is manually operable to bring the sleeve into two positions:
   (i) a generally horizontal upright position; and
   (ii) a collapsed position;

wherein the support structure consists of a first support element and a second support element;

wherein the first support element and the second support element are substantially fixed to the sleeve at a diverging angle from one another when the sleeve is fully extended, thereby enabling the support structure to be placed by a user in the upright position, and to maintain the upright position;

wherein the sleeve is operable in the generally horizontal upright position to permit debris to be directed inside the sleeve so as to funnel debris inserted in the top opening from the interior into the bag through the bottom opening; and wherein the sleeve defines a collection area in the collapsed position, and wherein the sleeve and the support structure permit the user to collect debris in the collection area and direct the debris collected in the collection area into the interior and then into the bag by lifting the sleeve.

2. A debris collector as claimed in claim 1, wherein the sleeve consists of a piece of flexible material, and the first support and the second support element each consist of a rigid circular element that wraps around the sleeve so as to define the interior within the piece of flexible material when the support structure is in the upright position.

3. A debris collector as claimed in claim 2, wherein the rigid circular elements are placed within a pair of inserts connected to or part of the piece of flexible material such that one of the first and second support elements leans toward the other in the upright position so as to enable the support structure to be placed by the user in the upright position, and to maintain the upright position.

4. A debris collector as claimed in claim 3, wherein:

(a) the pair of inserts consist of a first insert adjacent to the top opening and a second insert distal to the top opening;

(b) the pair of inserts are disposed in relation to the sleeve such that when the sleeve is in the upright position one of the first and second support elements leans toward the other; and (c) in the collapsed position, the sleeve and the support structure are operable to define a relatively flat area for collecting debris, and the top opening is generally disposed toward the top of the sleeve and the support structure in such collapsed position, such that when the sleeve and support structure are manually lifted from an area adjacent to the top opening, debris collected in the relatively flat area is generally directed toward the bottom opening and into the bag.

5. A debris collector as claimed in claim 1, wherein the connecting means consists of a plurality of fasteners disposed adjacent to the bottom opening, wherein the fasteners are operable to be manually fastened to a portion of the bag adjacent to a top opening of the bag.

6. A debris collector as claimed in claim 1, wherein the debris collector further comprises a closing means adjacent to the bottom opening, which closing means is operable to close the bottom opening, thereby permitting the sleeve to function as a bag.

7. A debris collector as claimed in claim 6, wherein the closing means consists of a zipper disposed in the sleeve adjacent to the bottom opening that is operable to be drawn to close the bottom opening.

8. A method of collecting debris comprising the steps of:

(a) providing a debris collector that includes a sleeve including a top, opening and a bottom opening, wherein the sleeve consists of a piece of flexible material, the sleeve being operable to be attached to a bag adjacent to the bottom opening, the sleeve defining an interior, a support structure connected to the sleeve, the support structure consisting of a first support element and a second support element, wherein the first and second support elements each consist of a rigid circular element placed within a pair of inserts connected to or part of the piece of flexible material so as to be substantially fixed relative to the sleeve at a diverging angle from one another when the sleeve is fully extended, wherein the support structure is manually operable to bring the sleeve in a generally upright position, and connecting means for connecting the bag to the sleeve;

(b) attaching a bag to the connecting means;

(c) manually operating the sleeve and the first support element and the second support element such that the first support element and the second support element is leaned toward each other so as to enable the sleeve to be placed by a user in the generally uptight position and to maintain the generally upright position;

(d) placing debris through the top opening inside the interior;

(e) manipulating the sleeve to direct the debris from the interior into the bag through the bottom opening; and (f) when a desirable amount of debris has been directed into the bag, detaching the bag from the connecting means and disposing of the bag.

9. A method as claimed in claim 8, comprising the further steps of:

(a) manually operating the sleeve to achieve a collapsed position in which a collection area is presented on which debris can be collected, and in which the top opening is disposed generally at the top of the sleeve and the support structure in the collapsed position;

(b) collecting debris on the top of the collection area; and (c) lifting the sleeve adjacent to the top opening and thereby directing the debris toward the bottom opening and into the bag.

* * * * *